US007845189B2

(12) United States Patent
Bauer

(10) Patent No.: US 7,845,189 B2
(45) Date of Patent: Dec. 7, 2010

(54) DOOR FOR A REFRIGERATION DEVICE

(75) Inventor: Peter Bauer, Munich (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 732 days.

(21) Appl. No.: 10/554,850

(22) PCT Filed: May 19, 2004

(86) PCT No.: PCT/EP2004/005441

§ 371 (c)(1),
(2), (4) Date: Oct. 27, 2005

(87) PCT Pub. No.: WO2004/104502

PCT Pub. Date: Dec. 2, 2004

(65) Prior Publication Data

US 2006/0273699 A1 Dec. 7, 2006

(30) Foreign Application Priority Data

May 21, 2003 (DE) ..... 103 22 974

(51) Int. Cl.
*F25D 11/00* (2006.01)

(52) U.S. Cl. ..... 62/440; 62/444

(58) Field of Classification Search ..... 62/449, 62/126, 259.1, 298, 440, 444, 441, 447, 465; 312/138.1, 234, 405, 401, 402, 109
See application file for complete search history.

(56) References Cited

U.S. PATENT DOCUMENTS 2,720,683 A * 10/1955 Schwenker et al. ..... 49/496.1
3,001,246 A * 9/1961 Mather ..... 312/236
3,124,501 A 3/1964 Wise
3,264,047 A * 8/1966 Steiner ..... 312/405
3,313,065 A 4/1967 Sandin
3,662,492 A * 5/1972 Bradley ..... 49/501
3,936,107 A * 2/1976 Gourdeau et al. ..... 312/329
4,966,004 A * 10/1990 Midlang et al. ..... 62/77
5,358,326 A * 10/1994 Cherry et al. ..... 312/405
5,487,276 A * 1/1996 Namisniak et al. ..... 62/125
6,840,773 B2 * 1/2005 Anderson et al. ..... 434/73
6,868,692 B2 * 3/2005 Choi ..... 62/389
7,043,886 B1 * 5/2006 Chubb ..... 52/656.4
2003/0209018 A1 11/2003 Becke et al.

FOREIGN PATENT DOCUMENTS

DE 94 08 458 9/1995

(Continued)

OTHER PUBLICATIONS

International Search Report for PCT/EP2004/005441.

*Primary Examiner*—Mohammad M Ali
(74) *Attorney, Agent, or Firm*—James E. Howard; Andre Pallapies

(57) ABSTRACT

A door for a refrigeration device having an internal wall and an external and a thermally insulting layer sandwiched between the walls. The external wall is divided into a first section that is covered with a decorative panel to match the surrounding furniture and an undecorated exposed second section. The first and second sections can be connected in two parts at the level of an undercut edge formed therebetween.

23 Claims, 1 Drawing Sheet

FOREIGN PATENT DOCUMENTS

Figure 1:
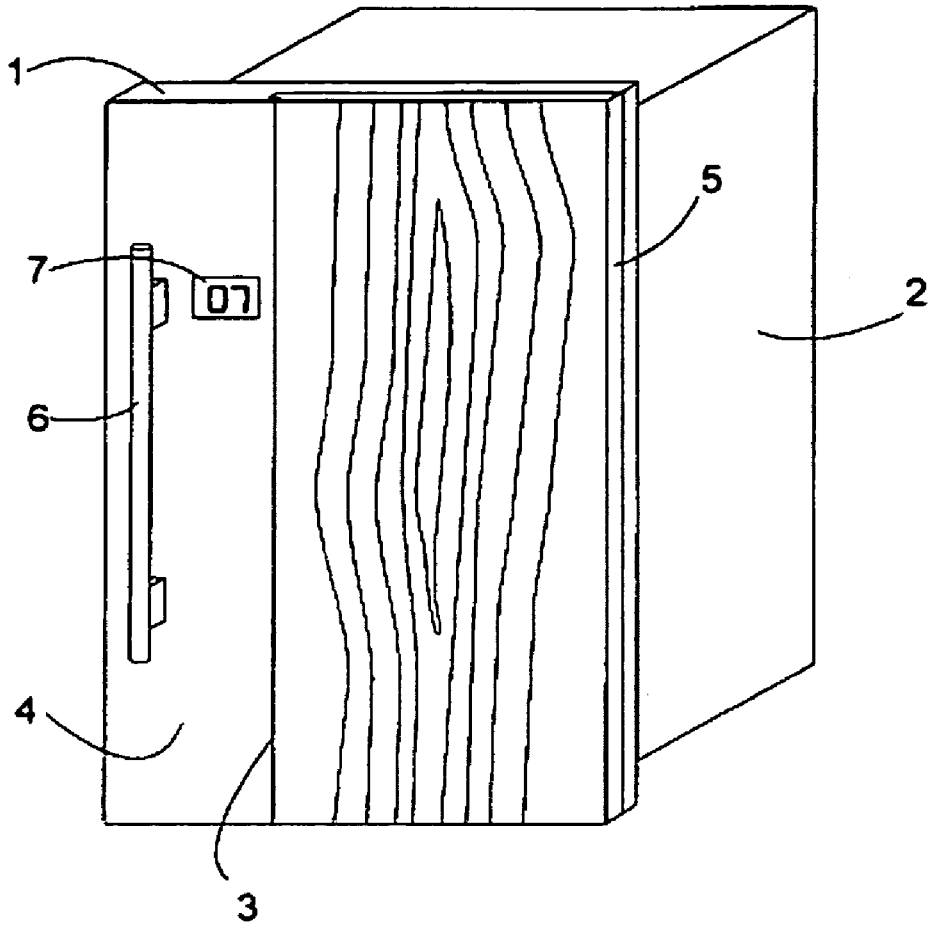

| | | | | |
|---|---|---|---|---|
| DE | 198 56 093 | | | 6/2000 |
| DE | 198 59 983 | | | 6/2000 |
| GB | 1 342 730 | | | 1/1974 |
| JP | 9-96488 | A | * | 9/1997 |
| JP | 2000 161840 | | | 6/2000 |
| JP | 2001-147082 | A | * | 5/2001 |
| JP | 2002 113867 | | | 1/2002 |
| JP | 2002 350042 | | | 12/2002 |
| JP | 2003-106749 | A | * | 4/2003 |
| WO | WO 01/71264 | | | 9/2001 |
| WO | WO 03/023298 | | | 3/2003 |

* cited by examiner

DOOR FOR A REFRIGERATION DEVICE

The doors of refrigeration devices conventionally have a multi-layer structure comprising an external wall and an internal wall which enclose a heat-insulating layer therebetween. In free-standing refrigerating devices, the external wall is freely visible over its entire area whereas in built-in devices it is covered by a furniture panel which is added by the manufacturer of the kitchen furniture into which the device is built.

The furniture panel behind which the refrigerating device is located cannot be distinguished from the outside from other closed panels, for example, forming ordinary cupboard doors.

A built-in refrigeration device would easily be identified as such if it were provided with an uncovered door usually used for free-standing devices but such a door would noticeably disturb the aesthetic overall appearance of a kitchen line into which it is built, particularly if high-quality materials such as real wood are used for the furniture fronts which are incompatible with the conventional white-painted sheet metal fronts of free-standing devices.

It is the object of the invention to provide a door for a refrigeration device which allows the refrigeration device to be built into a kitchen line without disturbing its overall aesthetic appearance and also making the refrigerating device identifiable as such.

The object is solved by a door having the features of claim 1.

A control and/or display panel for the refrigerating device can advantageously be placed on the exposed section of the door; however, for the identifiability of the device it is already sufficient if the exposed part is present, regardless of its shape. If a door handle is attached to the exposed section, the manufacturer of the refrigerating device can select this handle as aesthetically compatible with handles used on other types of kitchen appliances such as cookers or dishwashers manufactured by them.

Since the exposed section need only account for a small part of the total area of the door, it can be made of high-quality materials such as aluminium or stainless steel without considerable increased costs.

A simple and reliable fixing of the decorative panel is possible by providing an undercut at an edge of the exposed part facing the decorative panel, which can receive a tongue of the decorative panel.

In the area of the undercut an inconspicuous join can be simply made between a panel forming the exposed section of the door and a panel forming the covered section so that the panel forming the covered section, which is not visible on the device when it has been built in, can consist of a material selected purely from economic and technical aspects which does not need to satisfy any demands regarding its external appearance.

An area of the decorative panel facing away from the tongue is preferably fixed to the covered section in a covered fashion. Apart from the one exposed section, no further sections of the door thus need to remain visible when the decorative panel is mounted, i.e., differences in the appearance between the door according to the invention with mounted decorative panel and neighbouring furniture doors are exclusively limited to the one exposed section.

The covered section is preferably set back compared with the exposed section of the external wall so that the front of the decorative panel when mounted on the covered section is flush with the exposed section or only projects slightly thereover.

Since in this case, the heat-insulating layer projects further behind the exposed section that behind the covered section, a recess can be provided on the internal wall of the door behind the exposed part which enlarges the interior of the relevant refrigerating device without adversely affecting the insulating capacity.

The subject matter of the invention is also a refrigerating device with a door of the type defined above.

Figure 2:
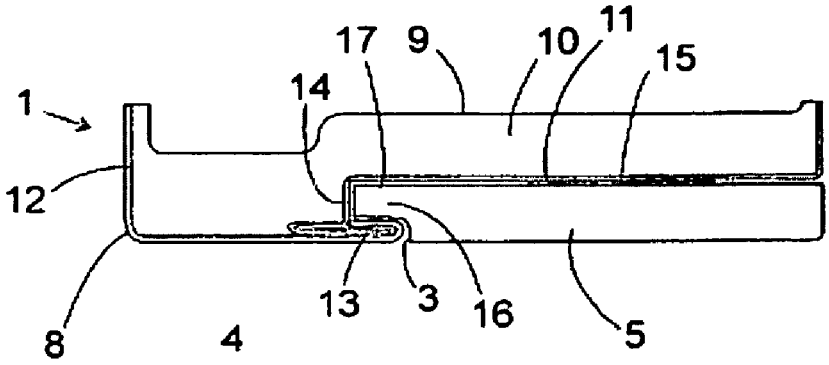

An exemplary embodiment of the invention is explained hereinafter with reference to the appended figures. In the figures:

FIG. 1 is a perspective view of a refrigerating device with a door according to the invention; and FIG. 2 is a horizontal section through the door of the refrigerating device, not to scale:

FIG. 1 shows a front perspective view of a refrigerating device with a door according to the invention. The dimensions of the door 1 are slightly larger than those of the front of a body 2 located therebehind so that the door 1 of the device not only completely covers the front of the body 2 but also a furniture recess in which the device is mounted. The door 1 can strike against the body 2 or against the furniture parts forming the building-in recess for the device.

The front of the door 1 is composed of two sections which adjoin one another along a vertical edge 3. One section is an exposed part 4 of the external wall of the door embodied directly as a visible face, the other section is a covered part 11 provided with a decorative panel 5, where the decorative panel 5 is mounted subsequently over the covered part 11 of the external wall of the door 1. The decorative panel 5 is joined subsequently to the body of the door 1. This allows the door 1 to be manufactured as standard for a plurality of application surroundings and to be adapted subsequently to furniture into which the refrigerating device is to be built.

The exposed part 4 forming the side of the door facing away from the stop has a handle 6 and a display panel 7 for displaying operating parameters of the refrigerating device such as the interior temperature, any faults etc. Control elements, possibly for setting a desired temperature for the interior, for switching on a fast-freeze mode in the case of a freezer etc. can be provided here. A mark or model designation of the manufacturer can also be accommodated on the exposed part 4.

FIG. 2 is a schematic section showing the structure of the door 1 with decorative panel 5 mounted thereon. The door is constructed of an external wall 8, an internal wall 9 which is arranged so that it is set back with respect to the exposed section 4 and faces the body 2, and a heat-insulating foam layer 10 enclosed between the external wall 8 and internal wall 9. The external wall 8 is composed of two components, of which one, a sheet of stainless steel or aluminium, forms the exposed part 4 and the other, which can comprise a painted steel sheet or a rigid plastic panel, for example, forms a section 11 covered by the decorative panel 5. The transition of the material pairing is produced by an edge 3 which is embodied as a rebate.

The sheet forming the exposed section 4 is bent at right angles on one side to form a side flank 12 of the door. The free edge of this side flank 12 is joined to the internal wall 9 in a foam-tight fashion. An opposite edge is bent back on itself to form a lug at the height of the edge 3 into which an edge strip 13 of the covered section 11 engages and in which said strip is held firmly by clamping, gluing, spot welding or another suitable technique.

Adjacent to the edge strip 13 is a section 14 which runs approximately perpendicular to the front into the interior of the door and adjacent to this is the flat main section 15 of the covered section 11 parallel to the front of the door. The join between the exposed part 4 and the covered part 11 forms an undercut or groove 16 along the edge 3. The undercut receives a tongue 17 of the decorative panel 5 and thus fixes its edge facing the exposed section 14. In an edge region of the decorative panel 5 facing away from this edge, covered retaining means are attached between its back and the covered section 11 of the external wall 8, which retaining means together with the undercut completely fix the decorative panel 5.

The decorative panel 5 can be made of the same material as the doors of neighbouring furniture elements and also has the same material thickness as such a furniture door for reasons of economic manufacture. It is feasible to select the width of the covered section 11 so that it fits the frame widths of all mass-produced furniture doors so that these mass-produced doors can be used as the decorative panel 5 substantially unchanged, i.e., assuming that the furniture doors are mass-produced in widths of 40, 50 and 60 cm, a width of 40 or 50 cm could be selected for the covered section 11 if the assumed width of the door of the refrigerating device 1 is 60 cm.

Since the outer surface of the exposed section 4 is substantially flush with the outer surface of the decorative panel 5 and the covered section 11 must accordingly be set back with respect to the exposed section 4 by the thickness of the decorative panel 5, different thicknesses of the insulating foam layer between the internal wall and the exposed section 4 on the one hand and between the internal wall and the covered section 11 on the other hand would be obtained if the internal wall is assumed to be flat, where the overthickness of the insulation behind the exposed section would contribute only little to the insulating effect of the door.

Thus a recess 18 is provided on the internal wall 9 in the area located behind the exposed section 4, which recess reduces the thickness of the foam layer at that point to approximately the same amount as that behind the covered section 11. This recess 18 enlarges the available interior of the refrigerating device and can be used advantageously if a bottle storage container, for example, is mounted on the internal wall 9 in order to accommodate bottles of overlarge diameter in the area of the recess 18 which can only be accommodated with difficulty in conventional storage boxes whose width remains the same.

The invention claimed is:

1. A door for a refrigeration device, comprising;

an external wall;

an internal wall;

a heat-insulating layer sandwiched between said walls, said external wall divided into a first section covered by a decorative panel and a second section that remains exposed, said external wall having a top edge and a bottom edge; and a substantially vertically orientated edge between said exposed second section and said decorative panel, said substantially vertically orientated edge extending from said top edge of said external wall to said bottom edge of said external wall; and retaining means for fixing an edge side border of said decorative panel provided at least in sections along said substantially vertically orientated edge, said retaining means including an undercut in said exposed second section along said substantially vertically orientated edge that receives said edge side border of said decorative panel disposed therein.

2. The door according to claim 1, including said external wall having a substantially uniform outer plane and at least one section which receives said decorative panel set back from said plane to form said covered section adjacent to said exposed section at said edge.

3. The door according to claim 1, including said set back section extends at least over a part of the height of said external wall.

4. The door according to claim 1, including said exposed section and said covered section formed of different materials, which sections are joined at said edge.

5. The door according to claim 4, including the material forming said covered section exhibits a less significant first impression than the material forming said exposed section.

6. The door according to claim 1, including a panel forming said exposed section and a panel forming said covered section are connected in said undercut.

7. The door according to claim 1, including an area of said decorative panel facing away from said edge side border of said decorative panel fixed to said covered section in a covered fashion.

8. The door according to claim 1, including said internal wall has a recess in an area opposite to said exposed section.

9. The door according to claim 1, including at least one of a control and a display panel placed on said exposed section.

10. The door according to claim 1, including a handle attached on said exposed section.

11. The door according to claim 1, including said exposed section formed from at least one of aluminum or stainless steel.

12. The door according to claim 1, wherein the decorative panel has a front surface, wherein the exposed second section has a front surface, and wherein the front surface of the decorative panel is substantially flush with the front surface of the exposed second section along the substantially vertically oriented edge.

13. A built-in refrigeration device, comprising:

a door including an external wall;

an internal wall;

a heat-insulating layer sandwiched between said walls, said external wall divided into a first section covered by a decorative panel and a second section that remains exposed, said external wall having a top edge, a bottom edge, and a pair of side edges each extending from said top edge to said bottom edge; and a substantially vertically orientated edge between said exposed second section and said decorative panel, said substantially vertically orientated edge extending from said top edge of said external wall to said bottom edge of said external wall and being spaced from each of said side edges of said external wall in a direction from one side wall to the other side wall; and retaining means for fixing an edge side border of said decorative panel provided at least in sections along said substantially vertically orientated edge, said retaining means including an undercut in said exposed second section along said substantially vertically orientated edge that receives said edge side border of said decorative panel disposed therein.

14. The refrigeration device according to claim 13, including said external wall having a substantially uniform outer plane and at least one section which receives said decorative panel set back from said plane to form said covered section adjacent to said exposed section at said edge.

15. The refrigeration device according to claim 14, including said exposed section and said covered section formed of different materials, which sections are joined at said edge and including the material forming said covered section exhibits a less significant first impression than the material forming said exposed section.

16. The refrigeration device according to claim 13, including a panel forming said exposed section and a panel forming said covered section are connected in said undercut.

17. The refrigeration device according to claim 13, including an area of said decorative panel facing away from said edge side border of said decorative panel fixed to said covered section in a covered fashion.

18. The door according to claim 13, wherein the decorative panel has a front surface, wherein the exposed second section has a front surface, and wherein the front surface of the decorative panel is substantially flush with the front surface of the exposed second section along the substantially vertically oriented edge.

19. A door for a refrigeration device, comprising;

an external wall;

an internal wall;

a heat-insulating layer sandwiched between said walls;

said external wall divided into a first section covered by a decorative panel and a second section that remains exposed, said external wall having a top edge, a bottom edge, and a pair of side edges each extending from said top edge to said bottom edge; and a substantially vertically orientated edge between said exposed second section and said decorative panel, said substantially vertically orientated edge extending from said top edge of said external wall to said bottom edge of said external wall and being spaced from each of said side edges of said external wall in a direction from one side wall to the other side wall; and retaining means for fixing an edge side border of said decorative panel along said substantially vertically orientated edge, said retaining means including an undercut in one of said exposed second section and said decorative panel along said substantially vertically orientated edge that receives the other of said exposed second section and said decorative panel disposed therein.

20. The door according to claim 19, including an area of said decorative panel facing away from said edge side border of said decorative panel fixed to said covered first section in a covered fashion.

21. The door according to claim 19, including said decorative panel and said exposed second section are arranged in side-by-side manner with one another to thereby form said external wall and each has a length dimension extending parallel to said substantially vertically orientated edge, the length dimensions of said decorative panel and said exposed second section are substantially equal to one another and are substantially co-extensive with one another, said decorative panel and said exposed second section each has a width dimension extending perpendicular to said substantially vertically orientated edge, the width dimension of said external wall is defined by the combined width dimensions of said decorative panel and the width dimension of said internal wall is substantially co-extensive with the width dimension of said external wall.

22. The door according to claim 21, including said decorative panel has a front surface terminating in said substantially vertically orientated edge and said exposed second section has a front surface and said substantially vertically orientated edge of said decorative panel is at least as far frontward as said front surface of said exposed second section as viewed in a back to front direction that is perpendicular to the height and width dimensions of said decorative panel and said exposed second section.

23. The door according to claim 19, wherein the decorative panel has a front surface, wherein the exposed second section has a front surface, and wherein the front surface of the decorative panel is substantially flush with the front surface of the exposed second section along the substantially vertically oriented edge.

* * * * *